US005140803A

United States Patent [19]

Biggs et al.

[11] Patent Number: 5,140,803

[45] Date of Patent: Aug. 25, 1992

[54] METHOD AND APPARATUS FOR FILLING CARTONS

[75] Inventors: Frederick Biggs, Middlesex; Charles E. Hawker, High Wycombe, both of England

[73] Assignee: A.G. (Patents) Limited, London, England

[21] Appl. No.: 689,795

[22] PCT Filed: Sep. 13, 1990

[86] PCT No.: PCT/GB90/01414

§ 371 Date: Jul. 19, 1991

§ 102(e) Date: Jul. 19, 1991

[87] PCT Pub. No.: WO91/04911

PCT Pub. Date: Apr. 18, 1991

[30] Foreign Application Priority Data

Sep. 27, 1989 [GB] United Kingdom ..... 8921760

[51] Int. Cl.[5] ..... B65B 5/10; B65B 61/00

[52] U.S. Cl. ..... 53/475; 53/244; 53/246; 53/534

[58] Field of Search ..... 53/475, 491, 250, 249, 53/247, 534, 48.9, 244, 540, 447, 526; 414/907, 788

[56] References Cited

U.S. PATENT DOCUMENTS

| | | | |
|---|---|---|---|
| 1,345,926 | 7/1920 | Harris . | |
| 2,524,032 | 10/1950 | Back | 53/491 |
| 3,443,355 | 5/1969 | Birrell | 53/534 |
| 3,485,008 | 12/1969 | Silver | 53/491 |
| 4,285,185 | 8/1981 | Collura et al. | 53/48.9 X |
| 4,433,526 | 2/1984 | Nord | 53/534 X |

*Primary Examiner*—Horace M. Culver
*Attorney, Agent, or Firm*—Charles E. Baxley

[57] ABSTRACT

An improvement in a method and related apparatus for filling a carton with successive stacks of articles, for example teabags. The carton is moved forward in a stepwise manner between filling steps. At least one side wall of the carton is distorted inwardly immediately behind a last deposited stack of the articles to restrain the stack from tipping over as a result of the movement.

20 Claims, 3 Drawing Sheets

METHOD AND APPARATUS FOR FILLING CARTONS

BACKGROUND OF THE INVENTION

The present invention relates to a method and apparatus for filling cartons or similar containers with sucessive stacks of articles. It is particularly, but not exclusively concerned with filling stacks of tea bags or similar infusion packages into cartons.

In a typical infusion packaging machine, measured doses of tea or another infusion are deposited in two parallel rows on a first moving web of thermoplastics coated filter paper whereafter a further web is laid over the first and individual pockets of infusion formed by heat sealing the webs together. The web is then cut to form adjacent separate packages or adjacent packages joined along a perforation line. These packages then move to a collation chamber where they are stacked and from where the adjacent collated stacks are moved into a device which inserts them into the carton. This latter device usually comprises opposed vertical plates which hold the stacks between them and which are moved down together into the carton where they are moved apart to deposit the stacks, whereafter they are retracted to receive the next pair of collated stacks. The carton is then moved forwardly by a suitable conveying means in a stepwise manner, by such an amount so that when the insertion device next moves downwardly, the carton will have moved forward sufficiently for the device to deposit the next stacks just behind the first previous ones. This sequence is repeated until the carton is full, whereupon a subsequent carton is moved beneath the plates for filling, and so on. The filling process is thus fully automated.

The respective sizes and shapes of the infusion packages and the cartons have traditionally been such that the sides of the stacks are supported to some extent by their frictional engagement with the side walls of the carton during its stepwise forward movement which is normally sufficient to prevent the stacks falling backwardly due to inertia. However, this may not be the case if for example a carton is oversize or if the infusion package is of a non rectangular shape, for example circular, which would lead to relatively poor support of the stacks by the side walls. Furthermore non-rectangular packages, for example circular packages, may be inherently less stable when stacked than rectangular packages. If a stack falls backwards into the carton, this will prevent subsequent stacks being placed satisfactorily.

STATEMENT OF INVENTION

The present invention seeks to overcome these problems by providing means which give additional support to a stack of articles in a container during moving.

From one aspect the invention provides a method of filling a carton or the like with successive stacks of articles, wherein the carton is moved forward in a stepwise manner between filling steps, and characterised in that at least one side wall of the carton is distorted inwardly immediately behind the last deposited stack during said movement to restrain said stack from tipping over as a result of such movement.

From a second aspect the invention also provides apparatus for filling a carton or the like with successive stacks of articles, comprising means for moving a carton in a stepwise manner with respect to a filling station, characterised in that means are provided for distorting at least one side wall of the carton inwardly behind a stack during said movement so as to restrain said stack from tipping over as a result of such movement.

The invention is particularly applicable to the filling of adjacent stacks of infusion packages into a carton but it could be equally applied to filling other articles into cartons.

Preferably both side walls of the carton are distorted inwardly, although situations can be envisaged where only one wall need be distorted, for example if the carton is filled with a single row of stacks. Where both walls are distorted, they need not be distorted inwardly by the same amount. In fact it is preferred that a side wall to which a carton lid (if present) is attached is distorted least so as to avoid later problems with closing the lid.

The carton walls may be distorted inwardly by arms or plungers arranged on either side of the carton which move with a reciprocating rectilinear or pivoting inward movement or indeed a combination of such movements. For example one arm may move with a rectilinear movement while the other pivots. Both arms would then move forwardly with the carton, retract outwardly so as to release the side walls, and then move backwards to their original positions to commence another cycle.

In a preferred embodiment the stepwise movement of the cartons is caused by a reciprocating conveying means adapted to grip the carton during forward movement thereof and to release it during each movement of the conveying means rearward, and the means for distorting the side wall(s) of the carton is carried by the conveying means and operates synchronously therewith. For example, in machines for filling stacks of infusion packages, it is normal to provide a pair of spring loaded plungers which act to grip the carton and move it in the above mentioned stepwise manner. Each plunger is normally mounted on a carriage which is reciprocated by suitable actuators in an inward and outward manner to effect the gripping and also longitudinally to effect the forward and backward movement. In a preferred embodiment, the arms for distorting the carton walls are mounted on the same carriages as these plungers to avoid the need for additional actuators.

In a preferred embodiment one arm, at the side of the carton to which the lid is attached, is mounted on the carriage so as that its inward motion is rectilinear, and it effects the same magnitude of inward movement as the carriage. The arm at the other side of the carton however is mounted so that it magnifies the inward movement of the carriage and effects a larger distortion on the carton wall for the reasons mentioned above. This may be achieved by pivotally mounting the arm on the carriage such that as the carriage moves inwardly, the arm not only moves inwardly as a whole but also pivots about an axis, thereby producing a magnified movement.

In a preferred embodiment, this movement is achieved through a first lever arm having means for engaging a carton wall being mounted on a carrier which is rotatably mounted with respect to the carriage and which also mounts a second lever arm which engages a fixed rail at the side of the carton track. Preferably the end of the lever arm is provided with a roller for engaging the rail, so as to reduce friction as the arm moves longitudinally along the rail during the forward and backward movement of the carriage. The second lever arm is preferably biased into engagement with the rail by suitable spring means. As the carriage moves inwardly, the second lever arm pivots the carrier and thus the first lever arm by virtue of its continued engagement with the fixed rail.

The size of the movement can be varied by varying the length of the first lever arm from the pivot point of the carrier to the portion which contacts the carton wall.

As mentioned above, the invention is particularly suitable for filling infusion packages into a carton. From another broad aspect, therefore, the invention provides a method of filling a carton or the like with successive stacks of infusion packages wherein the carton is moved in a stepwise manner between filling steps characterised in that a said stack is prevented from tipping over during such movement by means which cooperates with the stack, such means being operated synchronously with the means for moving the carton.

BRIEF DESCRIPTION OF DRAWINGS

A preferred embodiment of the invention will now be described, by way of example only, with reference to the accompanying drawings in which.

DESCRIPTION OF PREFERRED EMBODIMENT

Figure 1:
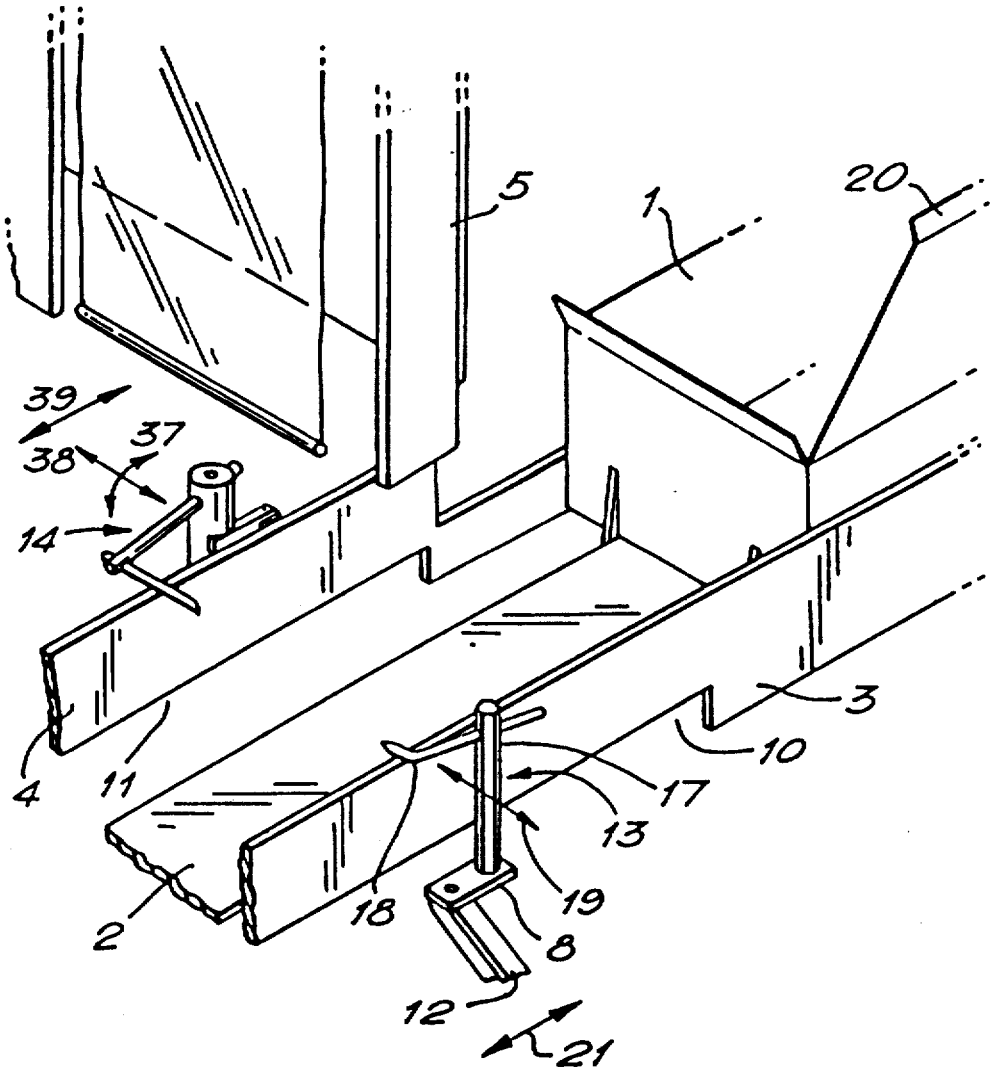
FIG. 1 shows a perspective view of apparatus embodying the invention.
Figure 2A:
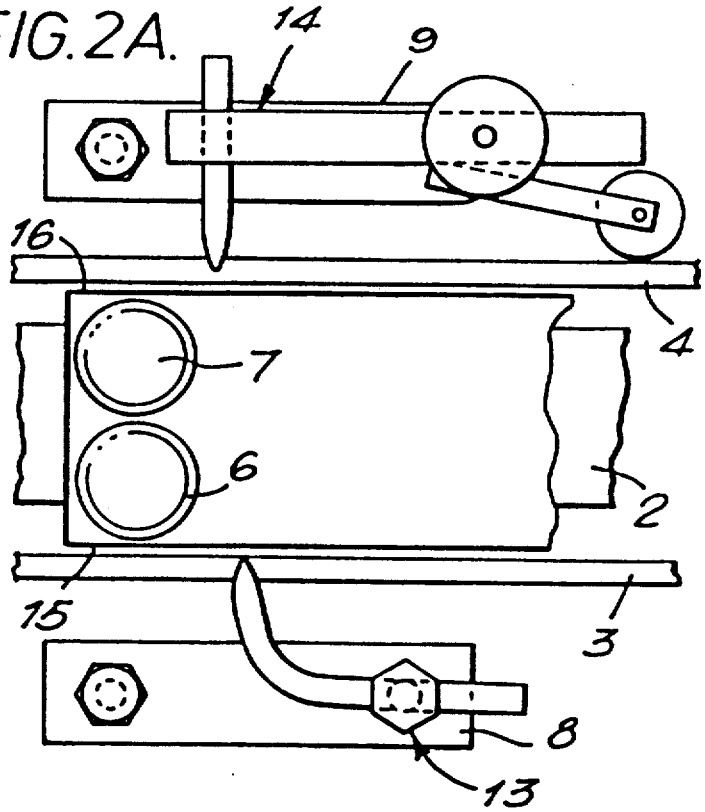
FIGS. 2*a* and 2*b* shows schematically two steps in the operation of the apparatus.

Referring to FIG. 1, there is shown apparatus for filling stacks of circular tea bags or other infusion packages into cartons. An empty carton 1 moves in a stepwise manner along a bed 2 in a channel defined by two side rails 3,4 and under a filling device 5. The lid 20 of the carton is at the "outboard" side of the machine so as not to be entangled with other parts of the machine. Two adjacent stacks of tea bags (not shown) are fed to the filling device 5 from a collating device in a conventional manner which need not be described in detail here. When the front of the carton 1 has moved into registry under the filling device 5, the latter moves down into the carton 1 and deposits the stacks side by side therein. The device 5 then withdraws from the carton. Such a condition is shown in FIG. 2*a*, with two stacks of tea bags 6,7 in position in the carton.

The carton 1 is then moved forward in a stepwise manner by an amount just greater than the tea bag diameter so that the next stacks (not shown) will be deposited in the carton just behind the stacks 6,7. This is achieved in a conventional manner by means of spring loaded transfer plungers (not shown) mounted on carriage plates 8,9 which move inwardly so as to allow the plungers to grip the lower part of the carton 1 through the cut outs 10,11 formed in the side rails 3,4. Once the plungers have gripped the carton, the plates 8,9 are moved forward by the required amount at which point they react outwardly to release the carton 1 and then move back along the direction of the bed 2 to their original position. The carriage plates 8,9 are moved by suitable actuators (only the upper part of one of which 12 is shown).

The plates 8,9 also mount arms 13,14 which protrude above the tops of the rails 3,4 and which act to distort the walls 15,16 of the carton inwardly during the forward movement of the carton so as to prevent the stacks falling backwards. The outboard arm 13 consists merely of an upright pillar 17 mounted onto the carriage plate 8 and an arm member 18 which is bent at one end for engagement with the upper part of the carton wall 15. Being directly mounted to the carriage plate 8, the arm 13 will reciprocate retilinearly as shown by arrows 19 and 21 in FIG. 1.

Figure 3:
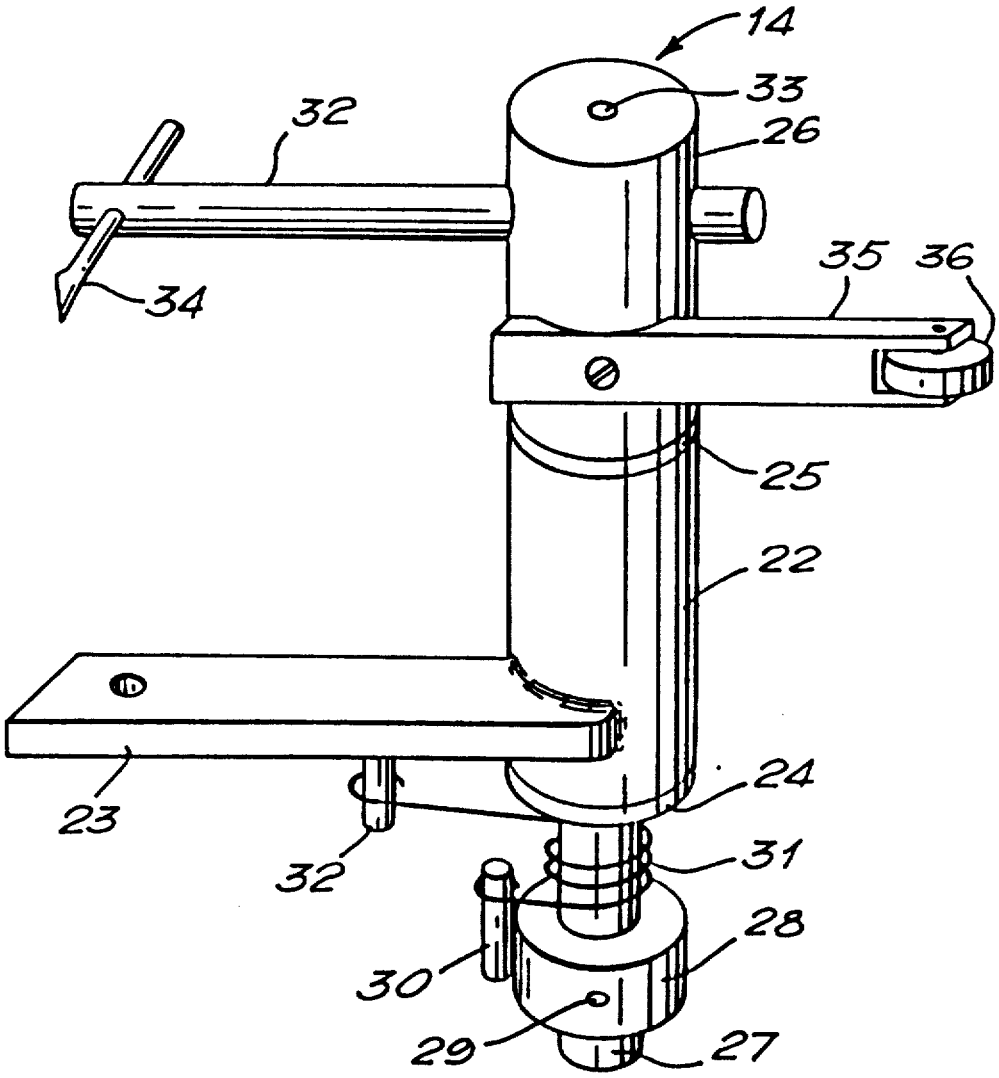
FIG. 3 shows an element of the apparatus in more detail.

The inboard arm 14 which is shown in more detail in FIG. 3 comprises a rotary bearing body 22 which is mounted on the carriage plate 9 via a plate 23. A bore extends through body 22 along its axis and two flanged bushes 24,25 extend into the bore from either end. This provides a rotary bearing for the arm carrier 26 which has a shaft portion 27 of reduced cross section extending through the support body bore. A spring support 28 is fixed to the lower end of the shaft 27 by means of a set screw 29 and has a post 30 for anchoring one end of a torsion spring 31 mounted around the shaft 27. The other end of the spring 31 is anchored on a post 32 which depends from plate 23. This spring 31 provides a return force for the arm as will be described later.

A first lever arm 32 is mounted in transverse bore in the carrier 26 and its position can be set by means of a set screw 33. A rod 34 is longitudinally adjustably mounted in a transverse bore in the arm 32. In use this rod 34 will extend above the side rail 4 for contacting the inboard carton wall 16.

The carrier 26 also mounts a roller support arm 35, at the opposite end of which is mounted a roller 36. The roller 36 is biased into contact with the side rail 4 by means of the torsion spring 31. The roller support arm 35 acts as a second lever arm, such that as the carriage plate 9 moves inwardly, it causes the arm carrier 26 to rotate about the bearing body 22, thereby rotating lever arm 32 and rod 34 inwardly to contact the inboard carton wall 16 thus effectively magnifying the movement of the plate 9. The magnitude of the movement may be varied by varying the free length of the lever arm 32 with the set screw 33. As the carriage plate 9 retracts outwardly, the spring 31 urges the arms 32 and 35 back into their original positions. The movement of the arm 14 can be represented by the arrows 37,38,39 shown in FIG. 1.

Figure 2B:
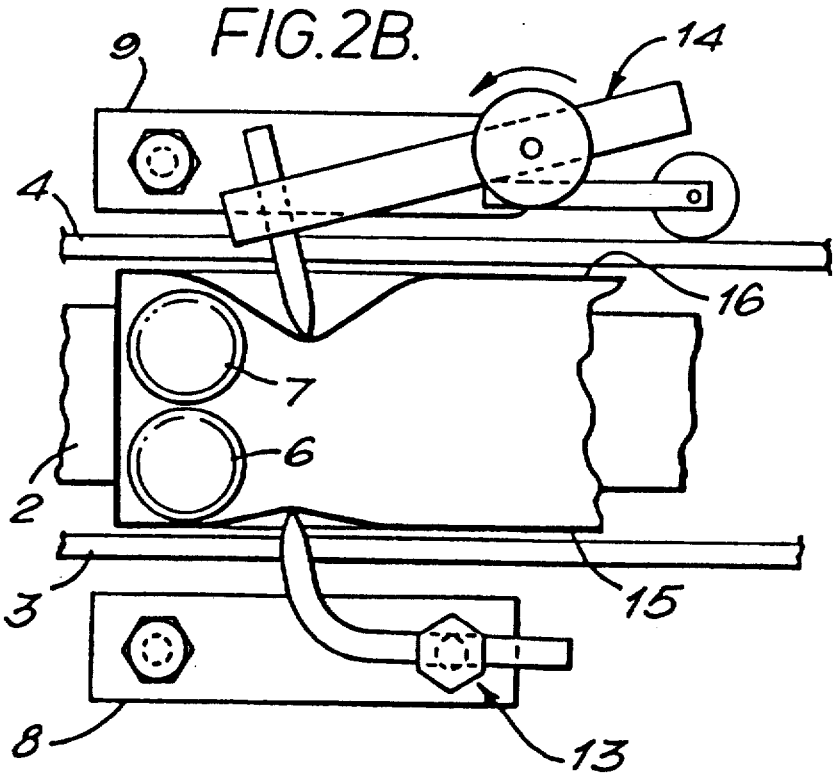

A single cycle of operation will now be described. Initially the arms 13,14 are in the retracted positions shown in FIG. 2*a*, immediately behind two stacks of tea bags 6,7 which have just been deposited in the carton. The carriage plates 8,9 then move inwardly so that the carton gripper plungers grip the carton for movement to the next position but also to move the arms 13,14 into contact with the carton walls. The outboard arm 13 moves rectilinearly inwardly while the inboard arm 14 performs a combined rectilinear and pivotal movement as described above. The effect of this movement is to distort the walls 15,16 of the carton behind the stacks 6,7 as shown in FIG. 2*b*. With the walls so distorted, the stacks 6,7 will be prevented from falling backwards during the transfer movement to the next stack filling position. The outboard wall 15 to which the lid 20 of the carton is attached is distorted less than the inboard wall 16 so as to avoid later problems with closing the lid.

When the apparatus has assumed the position shown in FIG. 2*b*, the carriage plates 8,9 are moved forward by an appropriate amount, to transfer the carton to its next filling position. The arms 13,14 maintain their inward positions, as shown in FIG. 2*b*, during the movement thereby preventing stacks falling during the motion. It will be noted that the roller 36 rolls along the side rail 4 during the forward movement.

When the transfer movement is complete, the carriage plates 8,9 are first retracted outwardly, to release the gripper plungers and the arms 13,14 which resume their outward position as shown in FIG. 2A. The carriage plates 8,9 are then moved backwardly, for example during the period that the next stacks are being filled so as to assume a position just behind the new stacks. This cycle is repeated as many times as is necessary to fill the carton.

It can thus be seen that at least in its preferred forms, the invention provides a simple and effective method and apparatus for overcoming the problems of filling irregular shaped or sized stacks into cartons. The invention also has the advantage that it can easily be applied retroactively to existing machinery without the need for major changes to the machinery.

It will of course be obvious to a person skilled in the art that the above description is only for the purposes of illustration and that many variations falling within the scope of the invention can easily be envisaged. For example if it is required to distort only one wall of the carton, one of the distorting arms may be dispensed with. It will also be appreciated that an arm mechanism other than that specifically described above may be employed, for example a pneumatic piston. Also while it is preferred that the arms are mounted on the reciprocating gripping carriages of the apparatus, this is not essential.

We claim:

1. An improvement in a method of filling a carton with successive stacks of articles, wherein the carton has at least one side wall and is moved forward in a stepwise manner between filling steps, comprising the step of using a distortion means to distort the at least one side wall inwardly immediately behind a last deposited stack of the said stacks during the movement to restrain the last deposited stack from tipping over.

2. The improvement in a method according to claim 1 further characterized in that the carton has two side walls and in the distortion step both of the side walls are distorted inwardly.

3. The improvement in a method according to claim 2 further characterized in that the side walls are distorted inwardly by different amounts.

4. An improvement in an apparatus for filling a carton having at least one side wall with successive stacks of articles, including moving means for moving the carton in a stepwise manner with respect to a filling station, comprising means for distorting the at least one side wall inwardly behind a last deposited stack of the said stacks during operation of the moving means so as to restrain the last deposited stack from tipping over.

5. The improvement in an apparatus according to claim 4 further characterized in that the carton has two side walls and the distorting means distort both of the side walls inwardly.

6. The improvement in an apparatus according to claim 5 further characterized in that the distorting means distort said side walls by different amounts.

7. The improvement in an apparatus according to claim 4 further characterized in that said distorting means comprise an arm reciprocable rectilinearly and an arm reciprocable rectilinearly and with a pivoting inward movement.

8. The improvement in an apparatus according to claim 4 further characterized in that the moving means include reciprocating gripping means organized for sequential forward and rearward movements and adapted to grip the carton during each of the forward movements thereof and to release it during each of the rearward movements thereof, the distorting means carried by the moving means and operable synchronously therewith.

9. The improvement in an apparatus according to claim 8 further characterized in that the gripping means are mounted on carriages reciprocable by actuators in an inward and outward manner to effect the gripping and also in a longitudinal manner to effect the forward and backward movement.

10. The improvement in an apparatus according to claim 9 further characterized in that the distorting means comprise an arm mounted on a said carriage.

11. The improvement in an apparatus according to claim 10 further characterized in that the arm is mounted on the carriage so that its inward motion is rectilinear, whereby to effect the same magnitude of inward movement as the carriage.

12. The improvement in an apparatus according to claim 10 further characterized in that the arm is mounted on the carriage to move relative thereto so that it magnifies the inward movement of the carriage and effects a larger distortion of the carton wall.

13. The improvement in an apparatus according to claim 12 further characterized in that the arm comprises a first lever having means for engaging the carton wall being mounted on a carrier which is rotatably mounted with respect to the carriage and which also mounts a second lever which engages a fixed rail at the side of the carton.

14. The improvement in an apparatus according to claim 13 further characterized in that the end of the second lever is provided with a roller for engaging the fixed rail.

15. The improvement in an apparatus according to claim 14 further characterized in that the second lever is biased into engagement with the fixed rail by a spring.

16. The improvement in an apparatus according to claim 9 further characterized in that the distorting means comprise a first arm mounted on a first of said carriages mounting said gripping means and a second arm mounted on a second of said carriages mounting said gripping means, said first arm moving inwardly with the same magnitude of inward movement as the first carriage, and the second arm moving inwardly with the second carriage so that it magnifies the inward movement of the second carriage.

17. The improvement in an apparatus according to claim 16 further characterized in that the second arm comprises a first lever having means for engaging the carton wall and being mounted on a carrier which is rotatably mounted with respect to the second carriage and which also mounts a second lever which engages a fixed rail at the side of the carton.

18. The improvement in an apparatus according to claim 17 further characterized in that a remote end of the second lever is provided with a roller for engaging the fixed rail.

19. The improvement in an apparatus according to claim 18 further characterized in that the second lever is biased into engagement with the fixed rail by a spring.

20. A method of filing a carton with successive stacks of infusion packages comprising:

providing moving means for moving the carton in a stepwise manner between filling steps;

filling a stack of infusion packages into said carton;

operating said moving means to move the carton; and operating, synchronously with the moving means, means which cooperate with the stack during the stepwise movement to prevent the stack from tipping over.

* * * * *